United States Patent [19]

Schebece et al.

[11] Patent Number: 4,554,097

[45] **Date of Patent: * Nov. 19, 1985**

[54] ELASTIC DETERGENT PRODUCT CONTAINING ANIONIC AND AMPHOTERIC SYNTHETIC ORGANIC DETERGENTS

[75] Inventors: Frank Schebece, Edison; John C. Carson, Jr., Manasquan Park, both of N.J.

[73] Assignee: Colgate-Palmolive Company, New York, N.Y.

[ * ] Notice: The portion of the term of this patent subsequent to Jan. 1, 1997 has been disclaimed.

[21] Appl. No.: 594,971

[22] Filed: Apr. 19, 1984

Related U.S. Application Data

[63] Continuation of Ser. No. 326,582, Dec. 2, 1981, abandoned, which is a continuation of Ser. No. 746,995, Dec. 2, 1976, abandoned.

[51] Int. Cl.[4] ..... C11D 1/50; C11D 17/00

[52] U.S. Cl. ..... 252/542; 252/DIG. 16; 252/117; 252/121; 252/122; 252/132; 252/134; 252/89.1; 252/546; 252/551; 252/535

[58] Field of Search ..... 252/89, DIG. 16, 174, 252/134, 132, 121, 122, 542, 546, 550, 551, 108, 117, 535

[56] References Cited

U.S. PATENT DOCUMENTS

| | | | |
|---|---|---|---|
| 3,442,812 | 5/1969 | Barnhurst | 252/DIG. 16 |
| 3,689,437 | 9/1972 | McLaughlin | 252/335 |
| 3,708,425 | 1/1973 | Compa et al. | 252/DIG. 16 |

FOREIGN PATENT DOCUMENTS

| | | | |
|---|---|---|---|
| 731396 | 6/1955 | United Kingdom | 252/DIG. 16 |
| 1194861 | 6/1970 | United Kingdom | 252/DIG. 16 |

*Primary Examiner*—Edith Buffalow

*Attorney, Agent, or Firm*—Herbert S. Sylvester; Murray M. Grill; Norman Blumenkopf

[57] ABSTRACT

An elastic detergent product which may also be used by children as a toy or plaything while taking a bath, includes a mixture of anionic and amphoteric synthetic organic detergents, gelatin and water. The products are substantially form-retaining and although they wear away during use, substantially retain their initial forms and elasticities for major proportions of their useful lives. They are easily manufactured and during the manufacturing process are moldable to finely figured and detailed shapes. Because of their elasticity they are resistant to breakage during shipping and use and because of their contents of both synthetic anionic and amphoteric organic detergents they exhibit less surface tackiness than other elastic detergent products or bars in which similar proportions of gelatin and water are present. In an improved process for the manufacture of such products having a lesser tendency to shrink upon prolonged exposure to the atmosphere, during the blending of the various product components heating is employed and is continued for a long enough time to evaporate a substantial proportion of water from the mixture, after which the composition may be poured into molds and solidified.

15 Claims, No Drawings

ELASTIC DETERGENT PRODUCT CONTAINING ANIONIC AND AMPHOTERIC SYNTHETIC ORGANIC DETERGENTS

This is a continuation of application Ser. No. 326,582, filed Dec. 2, 1981 now abandoned which is a continuation of Ser. No. 746,995 now abandoned.

This invention relates to elastic detergent products. More particularly, it relates to detergent products or bars intended for conventional toilet soap uses, either as hand "soaps" or bath or shower "soaps", which are elastic in nature and which include both synthetic organic anionic and amphoteric detergents. Such elastic detergent bars are less tacky than various other gelatin-based bars containing only either anionic or amphoteric detergent and such improved surface characteristic, together with their "squeezability", which makes them like a plaything for children, help make bathing more pleasant both for the child and his parent. Additionally, they foam better than other detergent bars.

Soap, synthetic organic detergent and soap-synthetic detergent bars and cakes have been made from literally thousands of different materials. It has long been known to incorporate perfumes, colorants, abrasives, bleaches, fillers, emollients and bodying agents in soap bars and gelatin is one of the bodying or binding agents that has been employed. Soap bars have usually contained glycerol and water, both of which are produced and utilized in various soapmaking processes when soaps are produced by the saponification of triglycerides. U.S. Pat. No. 2,360,920 discloses the production of soap buds from an aerated aqueous solution of soap containing glycerine and a demulcent, such as may be made from a mixture of Irish moss and gelatin. U.S. Pat. No. 3,698,437 teaches the manufacture of malleable and non-hardenable detergent products from certain percentages of a fatty acid isethionate, water, gelatin, hydrocarbon and filler. The resulting bars, which may also contain glycerol or propylene glycol and other adjuvants, are said to be moldable and extrudable but not elastic. British Pat. No. 731,396 describes a shaped soapless organic detergent composition in which the soapless detergent, such as triethanolamine alkylbenzene sulfonate, is dispersed in a gelatin gel. Aeration of the gel to produce a frothy product is suggested, as are the additions of various builders, fillers, nonionic detergents, etc. In copending U.S. Pat. No. 4,181,632, issued Jan. 1, 1980, which was filed on Dec. 2, 1976, the same day as the effective date of the present application, by Frank Schebece, improved synthetic organic detergent bars based on synthetic anionic detergent and cross-linked or denatured gelatin are described, as are detergent bars based on amphoteric detergents, with or without such cross-linking and/or denaturing agent(s). However, that application does not describe mixtures of synthetic organic anionic and amphoteric detergents in aqueous gelatin-based products and the unexpectedly beneficial advantages thereof.

Although the prior art has recognized that gelatin may be included in detergent compositions which may be desirably molded or shaped to bar or cake form and although the Schebece application mentioned teaches the employment of amphoteric detergents as the synthetic organic detergent component of such a bar the art did not describe nor suggest the bars of this invention wherein both anionic and amphoteric synthetic organic detergents are utilized. Furthermore, it did not suggest the advantages obtained due to such composition nor by the invented process wherein the moisture content of a composition of this invention is intentionally diminished to improve the ultimate properties of the molded bar.

In accordance with the present invention an elastic detergent product comprises about 10 to 80% of a mixture of anionic and amphoteric synthetic organic detergents in a proportion between about 1:5 and 5:1, about 5 to 30% of gelatin and about 5 to 60% of water. In preferred formulations the anionic detergent is a monoglyceride sulfate or a triethanolammonium higher fatty alcohol sulfate and the amphoteric detergent is an imidazolinium betaine or a betaiminodipropionate, although betaaminopropionates may also be employed. In the process embodiment of the invention such a product is made with a moisture content of about 5 to 40% by heating a mix containing more water so as to evaporate off from it about 15 to 50% of the weight of the mixture, as water, after which the composition may be deaerated (an optional step, but preferred), poured into a mold, solidified and removed from the mold, ready for use.

The anionic synthetic organic detergents of this invention include sulfated, sulfonated and phosphonated hydrophobic moieties, especially those which include higher hydrocarbyl groups (preferably fatty), such as alkyl groups of 8 to 20 carbon atoms, preferably of 10 to 18 carbon atoms. These compounds are usually employed as their water soluble salts, such as salts of alkali metals, e.g., sodium, potassium and triethanolamine and ammonia. For the present compositions these salts will usually be either sodium, potassium or triethanolamine salts and of these the triethanolamine (or triethanolammonium) salts will often be preferred. Among the various types of synthetic anionic organic detergents which may be useful are the linear higher alkylbenzene sulfonates, especially those of 12 to 15 carbon atoms, e.g., sodium linear tridecylbenzene sulfonate; paraffin sulfonates; olefin sulfonates, higher fatty alcohol sulfates; monoglyceride sulfates, especially the sulfated monoglycerides of coconut oil, tallow, hydrogenated coconut oil, hydrogenated tallow and synthetic higher fatty acids of 8 to 20 carbon atoms, e.g., sodium coconut oil monoglyceride sulfate, ammonium cocomonoglyceride sulfate; corresponding sulfates and phosphonates and other equivalent organic sulfonates, in most of which the lipophilic group includes a chain of 10 to 18 carbon atoms. In the above description and elsewhere in the specification and in the claims when a material is characterized as a "monoglyceride sulfate" such terminology is intended to describe higher fatty acid monoglyceride sulfates wherein the higher fatty acid is of 8 to 20 carbon atoms, preferably of 10 or 12 to 18 carbon atoms, such as lauric acid, myristic acid, palmitic acid, stearic acid and oleic acid. Additionally useful are the sulfates and sulfonates of nonionic detergents and of nonionic surface active agents, in which products the nonionic base will normally be a polyethylene oxide condensation product of a higher fatty alcohol, such as a condensation product based on a higher fatty alcohol of 10 to 18 carbon atoms, wherein the ethylene oxide content is from 3 to 30, preferably 5 to 10 or 12 mols of ethylene oxide per mol of higher fatty alcohol. A specifically preferred anionic detergent is ammonium monoglyceride sulfate of 8 to 18 or 20 carbon atoms in the fatty acid group, e.g., ammonium cocomonoglyceride sulfate (coco indicates derivation of the fatty acids from coconut oils), although alkali metal monoglyceride sulfates, such as sodium monoglyceride sulfate, are also useful.

While sodium lauryl sulfate is an anionic synthetic organic detergent which may be employed, preferably in minor proportion with other anionic synthetic organic detergents in the present compositions, its use is usually not preferable and the corresponding triethanolammonium salt is normally used instead because it can produce a clear bar of good washing and foaming ability which is also stable on storage and maintains its elasticity during use.

The amphoteric detergents which may be utilized to manufacture the elastic detergent bars of this invention include such compounds as Deriphat® 151, which is sodium N-coco-betaaminopropionate (manufactured by General Mills, Inc.), Deriphat 160, a partial sodium salt of N-lauryl-betaiminodipropionate, and other betaaminopropionates and betaiminodipropionates, Miranol® C2M (anhydrous acid form, 1-carboxymethyl-1-carboxyethoxyethyl-2-coco-imidazolinium betaine), the water soluble salts thereof, especially the triethanolammonium salt, and other imidazolinium betaines, and other of the various known amphoterics, described in McCutcheon's *Detergents and Emulsifiers,* 1973 Annual and in *Surface Active Agents,* Vol. II, by Schwartz, Perry and Berch (Interscience Publishers, 1958), the descriptions of which are incorporated herein by reference. For example, Deriphats 151C, 154, 160, 160-C and 170-C, and Miranols $C_2M$, S2M and SHD Conc. may be employed. Additionally, even liquid amphoteric detergents may be used, at least in part, e.g., up to 25 or 50% of the amphoteric detergent content. The recited incorporated references also contain extensive descriptions of various suitable anionic detergents and of nonionic and cationic detergents which may be employed in small proportion(s) in the present compositions. The various long chain substituents in the mentioned amphoterics are of 8 to 20 carbon atoms, preferably of 10 to 18 carbon atoms and most preferably are lauryl and coco.

The nonionic detergents, while not required components of the invented products, may be present in relatively small proportions therein in replacement of some of the anionic or amphoteric detergents. The nonionics are preferably solid or semi-solid at room temperature, more preferably solid, and include but are not limited to ethoxylated aliphatic alcohols having straight or branched chains (preferably straight chain) of from about 8 to 20 carbon atoms, with about 3 to about 30 ethylene oxide units per molecule. Particularly, suitable nonionic detergents of such type are manufactured by Shell Chemical Company and are marketed under the trademark Neodol®. Of the various Neodols available, Neodol 25-7 (12–15 carbon atoms chain higher fatty alcohol condensed with an average of 7 ethylene oxide units per mol) and Neodol 45-11 (14–15 carbon atoms chain higher fatty alcohol condensed with an average of 11 ethylene oxide units per mol) are particularly preferred. Another suitable class of ethoxylated aliphatic alcohol detergents is made by Continental Oil Company and is sold under the trademark Alfonic®. Of the Alfonics the most preferred is Alfonic 1618-65, which is a mixture of 16 to 18 carbon atoms primary alcohols ethoxylated so as to contain 65 mol percent of ethylene oxide. Additional examples of nonionic synthetic organic detergents include those marketed by BASF Wyandotte under the trademark Pluronic®. Such compounds are made by condensation of ethylene oxide with a hydrophobic base formed by condensing propylene oxide with propylene glycol. The hydrophobic portion of the molecule has a molecular weight of from about 1,500 to 1,800 and the addition of polyoxyethylene (or ethylene oxide) to such portion increases the water solubility of the molecule as a whole, with the detergent being a solid at room temperature when the polyoxyethylene content is above 50% of the total weight of the condensation product. Such a nonionic detergent is Pluronic F-128 but F-68 may also be employed. Also useful nonionic detergents are the polyethylene oxide condensates of alkyl phenols, such as the condensation products of such compounds wherein the alkyl group contains about 6 to 12 carbon atoms, in either a straight chain or branched chain configuration, with 5 to 25 mols of ethylene oxide per mol of alkyl phenol. The alkyl substituents in such compounds may be derived from polymerized propylene or may be diisobutylene, octene or nonene, for example.

Representative cationic detergents, which usually also possess antibacterial (and fabric softening) properties, include di-higher alkyl di-lower alkyl ammonium halides such as distearyl dimethyl ammonium chloride, and 2-heptadecyl-1-methyl-1-[(2-stearoylamido)ethyl]-imidazolinium methyl sulfate. The higher alkyls thereof are of 8 to 20 carbon atoms, preferably 12 to 18 and the lower alkyls are of 1 to 4 carbon atoms, preferably 1 and 2. Such materials are normally omitted from anionic detergent based products but may be employed in small proportions in mixed anionic-amphoteric detergent bars, especially when they contain more amphoteric detergent than anionic detergent and when the proportion of anionic detergent is relatively small.

Gelatin, a complex mixture of collagen degradation products of molecular weight in the range of about 30,000 to 80,000 and higher, depending on the hydrolytic conditions to which it has been subjected, is a vital constituent of the present compositions. Apparently because of its outstanding ability to form reversible gels, its high viscosity and the excellent strengths of films thereof, it helps to make a detergent bar which is of satisfactory strength and cleaning power, due to gradual dissolution of the ordinarily extremely soluble synthetic organic detergent component, and yet, which does not produce objectionable and unacceptable soft gels at bar surfaces which have been moistened. Additionally, and a major advantage of the present invention, the combination of gelatin and synthetic organic detergents, in the presence of water and preferably also in the presence of a lower dihydric or polyhydric alcohol or other suitable plasticizer, and often too, a cross-linking agent or denaturant, yields elastic products. The elastic detergent bars made are sufficiently elastic so that a bar 2 cm. thick can be pressed between thumb and forefinger to a 1 cm. thickness and will immediately (within five seconds) return to the 2 cm. thickness or at least to within 1 mm. thereof, upon release of pressure.

The gelatin employed is essentially colorless and free from odor. It is amphoteric (about 45 milliequivalents of amino functions and about 70 milliequivalents of carboxyl functions per hundred grams thereof). It is normally used in formulating as a dry granular product which is crystalline in appearance although it is really amorphous. It is insoluble in cold water but swells rapidly in the presence of water until it has imbibed about 6 to 8 times its weight thereof and it melts to a viscous solution in water when warmed to above 40° to 45° C. Gelatins are classified as either type A or type B, the former being from acid-cured stock, with an isoelectric point of about 8.3–8.5 and the latter being of alkalicured stock, with an isoelectric point of about 4.8–5.0. Type A gelatins are preferred for the present applications but type B gelatins may also be used, as may be mixtures of the two. The gelling powers of gelatins are normally measured by the Bloom test. Often too, viscosity will also be employed to characterize a gelatin and a gel strength:viscosity ratio may be specified, e.g., 3:1 to 5:1. Gel strengths will range from 100 to 300 g. Bloom but will usually be in the range of 150 or 200 to 300, with gelatins of Bloom values of 225 g. and 300 g. being employed in the examples herein. The type A gelatins will generally be utilized with the usual detergent bar constituents normally intended for employment in neutral or slightly basic aqueous media, and the type B gelatins will be preferred when acidic conditions are expected to be encountered.

Cross-linking agents for gelatin and for other proteins are metal salts which cross-link various gelatin molecules, apparently by reacting with free carboxyl functions thereof. This class of compounds is well known and the salts employed are usually those of aluminum, calcium, magnesium and/or zinc that are soluble in aqueous media. In such salts the preferred anions are chloride, bromide, iodide, sulfate, bisulfate and acetate but other suitable anions may also be included. Examples of such salts include potassium aluminum sulfate hydrate [alum, $KAl(SO_4)_2.12H_2O$], aluminum chloride, other alums, calcium chloride, magnesium sulfate and zinc acetate. Also useful for cross-linking is formaldehyde, usually as formalin. 0.1 To 1% of formaldehyde is normally adequate. Although the presence of a cross-linking agent is often highly desirable in the formulations of the invented bar compositions, especially those based on anionic detergents primarily, it has been found that such are not as important or useful in those compositions based primarily on amphoteric detergents.

Instead of or in addition to a cross-linking agent there may be employed with the gelatin of the present compositions a denaturant. Such a compound also helps to reduce solubility of gelatin at and near its isoelectric point and inhibits crystallization. Although denaturation may be effected by various materials, including various detergents, ethanol, acetone, strong acids and strong alkalis, chemical denaturation, usually by urea, dextrose or guanidine hydrochloride is preferred and of these compounds urea is by far the preferred. Both cross-linking and denaturation and the combination thereof are helpful in producing a lastingly elastic detergent bar of desired properties, suitable for repeated and satisfactory cleaning applications, but neither cross-linking agents nor denaturants for gelatin are required to make a satisfactory elastic detergent bar of the present invention.

The lower dihydric and/or polyhydric alcohol component(s) of the present bars functions as a mutual solvent and plasticizer for the bar components, especially the gelatin. It facilitates solubilization of the detergent at a desired rate and maintains the surface of the bar soft. If the bar became objectionably hard at portions thereof this could be cause for rejection of it by consumers. Such alcohol also helps to distribute the various components evenly throughout the bar or cake. Although a variety of lower dihydric or polyhydric alcohols may be employed, including various sugars and sugar alcohols, having up to 6 carbon atoms and up to 6 hydroxyls per molecule, the most preferred are those of 2 to 3 carbon atoms and 2 to 3 hydroxyl groups per molecule. Such compounds include propylene glycol (1,2-dihydroxypropane or 1,2-propylene glycol), trimethylene glycol (1,3-propylene glycol) and glycerol, of which 1,2-propylene glycol, glycerol and mixtures thereof are preferred. Other useful solvents are the Cellosolves®, the mono- and di-lower alkyl ethers of ethylene glycol. Additionally, sometimes monohydric alcohols, such as ethanol, are useful, primarily as supplementary solvents.

The water employed is preferably deionized water which will normally contain less than 10 parts and preferably less than 1 part per million of hardness, as calcium carbonate, but normal city waters may also be utilized, such as those having hardnesses in the range of 10, 20 or 50 to 150 or 300 p.p.m., as $CaCO_3$.

With the basic elastic detergent bar composition there may be present various adjuvant materials in minor proportions to contribute their particular properties to the final product. Among such adjuvant materials are functional and aesthetic adjuvants, such as: perfumes; pigments; dyes; optical brighteners; skin protecting and conditioning agents, e.g., lanolin, solubilized lanolins; bactericides; chemical stabilizers, e.g., sodium bisulfite; foam stabilizers, e.g., lauric myristic diethanolamide; buffering agents and pH adjusters, e.g., triethanolamine, hydrochloric acid, phosphates; bodying agents, e.g., clays; superfatting agents, e.g., stearic acid; anti-redeposition agents and soil dispersants, e.g., polyvinyl alcohol, sodium carboxymethyl cellulose; gums, e.g., sodium alginate, which also functions as a slip improving agent; and abrasive or scouring components, e.g., silex. Usually the present bars do not and should not contain any fillers or builder salts other than those which may accompany, usually unavoidably, other components of the product. However, in certain circumstances, as when bars for heavy duty laundry use are made, it may be desirable to add fillers, such as sodium sulfate and sodium chloride and builder salts, such as pentasodium tripolyphosphate, sodium carbonate and sodium silicate.

The proportions of the various components of the present elastic detergent bars should be kept within ranges to be given to obtain the best results and to produce a bar which will be desirably elastic, useful in place of conventional soap, soap-detergent and detergent bars and which will possess improved properties, such as a lesser tendency to slough when in contact with water, compared to such more conventional bars. The synthetic organic detergent component, the mixture of anionic and amphoteric detergents, will be about 10 to 80% of the product, preferably 35 to 65 or 70% and more preferably 35 to 55% thereof. The content of cross-linking agent and/or denaturing agent for the gelatin, when present, is usually 0.1 to 5%, preferably 1 to 3% and more preferably 1 to 2% total. Normally the percentage of cross-linking agent will be 0.1 to 5%, preferably 1 to 2% and that of the denaturant will be 0.5 to 2%. The gelatin, preferably type A gelatin of 225 to 300 g. Bloom, will be about 5 to 30%, preferably 7 to 25% and more preferably about 10 to 20% of the finished bar or cake and the moisture content will be about 5 to 60%, preferably 10 to 40% and more preferably 10 to 30%, e.g., 25%.

The lower dihydric or polyhydric alcohol, which may be omitted if syneresis problems are encountered (usually due to a high percentage of normally liquid components of the product), will normally be present in the range of 3 to 20%, preferably 10 to 18%, e.g., 15%.

The total proportion of various adjuvants present, including any builders and fillers, will normally not exceed 10%, preferably will be less than 5% and more preferably will be less than 2%, with the proportion of any particular adjuvant usually being held to less than 5%, preferably less than 2% and more preferably less than 1%.

The manufacture of the present elastic detergent bars is comparatively simple, requiring only the mixing together of the components under such conditions that the gelatin will form a gel with water and/or with any other components present. For example, all the components of a particular detergent composition may be mixed together and heated, with stirring, to dissolve the gelatin. Alternatively the gelatin may be first dissolved in water and the other components may then be admixed or other operative mixing sequences may be adopted. If the components are soluble the product may be transparent or at least transluscent but if insoluble ingredients are employed, which may be done intentionally, an opaque gel results. To clarify transparent gels and to increase the strengths and densities thereof these may be deaerated or degassed under vacuum or by allowing the hot or warm liquid to stand until it becomes clarified. The solution or dispersion may then be poured into suitable molds, chilled and thereby solidified. Although gelatin dissolves at temperatures above 40° or 45° C. it is normally undesirable to heat it to a temperature above 100° C. and preferably dissolving will take place at a temperature in the range of about 50° to 90° or 95° C., more preferably about 60° to 80° C., over 3 to 30 minutes. Molds will be at a temperature of 5° to 20° C., preferably 5° to 15° C. After the gelatin has completely set, which may take from about one minute to an hour, usually taking from three to ten minutes, the elastic detergent bar or cake may be removed from the mold and packed or it may be allowed to be warmed to room temperature before packing, at which temperature it still remains firm, yet elastic.

In a preferred process embodiment of the invention a firmer bar is made which has lesser tendency to shrink on storage and develop syneresis. Such a bar may contain: 10 to 80% of the mixture of anionic and amphoteric synthetic organic detergents in a proportion between about 1:5 and 5:1, preferably 35 to 65% of such mixture in a proportion within the range of 1:4 to 2:1, and more preferably the anionic detergent is triethanolammonium lauryl sulfate and the amphoteric detergent is triethanolammonium 1-carboxymethyl-1-carboxyethoxyethyl-2-coco-imidazolinium betaine; 5 to 30% of gelatin, preferably 7 to 25% thereof and more preferably the gelatin is a type A gelatin of 150 to 300 g. Bloom; and 5 to 40%, preferably 10 to 40% and more preferably about 10 to 25 or 30% water. In the improved process the components mentioned and any other solvents, plasticizers, cross-linking agents, denaturants and adjuvants may be mixed together and the gelatin is dissolved in the mixture or in the water thereof, with heating. Preferably the total proportion of water plus solvent plus plasticizer present will be in the ranges previously mentioned for water alone in the final bar but during dissolving of the gelatin, during which the temperature may be raised, as previously described, enough additional water will be employed initially to facilitate solution of the gelatin and it will be heated for a period sufficient to drive off water (or water plus solvent, etc.) to the extent of 15 to 50% of the weight of the mixture, preferably 20 to 40% thereof. In addition to heat, vacuum may be used to facilitate removal of the moisture and any volatile solvent present, such as ethanol. Normally the additional heating to remove moisture, depending on whether or not vacuum is also employed, may take from one minute to thirty minutes and preferably will take from one minute to fifteen minutes. After removal of the moisture the mix may be molded in the manner previously described, but yields the superior product mentioned.

The elastic detergent bars of this invention possess an obvious novelty advantage over ordinary soap or detergent bars. They are especially attractive to children when molded into various special shapes, such as the shapes of storybook or cartoon characters, animals, etc., and promote the enjoyment of bathing by infants and young children. The elastic nature of the product allows a controlled dispensing of detergent and other foaming materials onto the skin or into the bath water in response to repeated squeezings and relaxings of the bar. Thus, the utilitarian detergent is also a delightful toy. However, the product has various other advantages apart from its play value. Thus, the presence of the gelatin adds a skin care ingredient to the composition and because of the bar's elasticity breakage during shipment and on storage are minimized. Furthermore, large quantities of synthetic organic detergent may be present in the composition without the need for extensive use of waxes, plasticizers, bodying agents, etc., to control the dissolving thereof and give them desirable tactile properties and good appearances. The bars do not slough excessively, as often do detergent and soap bars and additionally, they maintain substantially their original shapes during use, continually dispensing detergent in response to compression and expansion and rubbing against areas to be cleansed. They have a different "feel" than soap when contacting the skin and this better contact assists in cleaning. The detergents in the bars or other shaped articles are readily released at temperatures of 25° to 40° C. and higher and for cold water washing, at temperatures of 10° C. and less, more soluble and lower Bloom value gelatins can be employed, with appropriate solvents and adjuvants, to help release the detergent. When made by the preferred process, wherein the percentage of moisture in the final product is limited to 40%, and preferably is about 25%, any tendency of the bar to shrink on storage is diminished and a firmer product results. Additionally, surface tackiness is noticeably decreased and the bar foams better than corresponding anionic and amphoteric bars, respectively.

It is to be understood that within the proportions of components given variations may be made to best promote desired properties of the bars manufactured and similarly, processing modifications may also be effected. Thus, proportions of gelatin, detergent, water, cross-linking agent, denaturant, plasticizer and adjuvants may be adjusted, as may be the types of such materials. For example, if the bar is too soft an increase in the solids content and especially in the gelatin content may be desirable and the gelatin type may be changed to that of a higher Bloom value to increase the firmness of the product. Also, in such a case it may be desirable to utilize more cross-linking agent and/or denaturant. If the bar is too firm, reverse adjustments may be made. Those of skill in the art, with this specification before them, will be able to modify the properties of the described compositions to make them conform to desirable product standards and similarly will be able to modify the processes described.

The following examples illustrate but do not limit the invention. Unless otherwise indicated all temperatures are in °C. and all parts are by weight.

EXAMPLE 1

| | Percent |
|---|---|
| Triethanolammonium lauryl sulfate | 8.0 |
| Gelatin (300 g. Bloom type A) | 10.0 |
| Propylene glycol | 10.0 |
| Triethanolamine salt of Miranol C2M anhydrous acid (triethanolamine 1-carboxymethyl-1-carboxy-ethoxyethyl-2-coco-imidazolinium betaine) | 28.0 |
| Water | 44.0 |

The components of the above formula are blended together and are heated with stirring, to a temperature in the range of 60° to 80° C. to dissolve the gelatin and the various other materials. After about 5 to 10 minutes a clear solution or gel is obtained, which is poured into shaped molds and chilled to 15° C. Upon solidification, which takes about eight minutes, the elastic detergent bar or cake is removed from the mold and is ready for use. The product is satisfactorily elastic and cleans well when it is employed as a bath or hand "soap". It foams very well on initial use and although the foam is diminished upon subsequent uses the bar is a useful washing product and maintains its elasticity throughout repeated washings and dryings. Such bar, containing amphoteric and anionic synthetic organic detergents, with gelatin, does not slough objectionably during use and is less tacky and better foaming than previous bars based on only anionic or amphoteric detergents, respectively.

In a modification of the manufacturing process the hot mixture of bar components is allowed to stand at an elevated temperature in the range of 45° to 55° C. for a period of one hour so as to allow all air bubbles therein to be dissolved or to rise to the top of the mix and separate therefrom before setting of the gel. The products resulting are brighter and clearer in appearance following such deaeration, during which relatively little water and other solvents are evaporated. However, when the temperature of the mixture is raised, e.g., to 60° or 65° to 80° to 90° C., as it is in other embodiments of this example, appreciable loss of water and other volatile materials results and the moisture content of the resulting bar is appreciably diminished. Thus, utilizing a 15 to 30 minute heating period at 80° C., especially in the presence of vacuum, e.g., 250 mm. Hg absolute pressure, 20 to 40%, e.g., 25% of the mix weight is removed. After the evaporation off of 25% of the mix the elastic detergent bar produced includes 11% of triethanolammonium lauryl sulfate, 13% of gelatin, 13% of propylene glycol, 38% of Miranol C2M as the triethanolammonium salt and 25% of water. The elastic detergent bars resulting (deaeration may be effected, too) are firmer, tougher and less liable to shrink upon prolonged exposure to the atmosphere during storage.

When the formula is modified to replace the triethanolammonium lauryl sulfate with the same weight of other suitable anionic detergent, such as ammonium cocomonoglyceride sulfate or a mixture of equal parts of ammonium cocomonoglyceride sulfate and sodium cocomonoglyceride sulfate and when the propylene glycol is replaced by glycerol a product of comparable properties results. Similarly, when the Miranol C2M salt is replaced by Deriphat 151 or Deriphat 160 or other suitable amphoteric detergent, especially one of the imidazolinium betaine, betaaminopropionate or betaiminodipropionate type and when the gelatin is replaced by 15% of 225 g. Bloom type A gelatin (type B may also be used but is not usually as good) essentially the same type of elastic detergent bar results. Similarly, when 2% of potash alum (cross-linking agent) or 1% of urea (denaturant) is present in replacement of a corresponding percentage of water a firmer bar results. When adjuvants are employed, such as fluorescent brighteners; bactericides; emollients; solvents; foaming agents, e.g., lauric myristic diethanolamide; pH adjusting agents, e.g., hydrochloric acid, triethanolamine; perfumes; colorants, including dyes and pigments; and preservatives, they contribute their specific properties to the final bar.

In further modifications of the formula small proportions of dyes and pigments are incorporated to color and opacify the products and gels are molded in chilled molds into the shapes of specific storybook, nursery rhyme, cartoon and animal characters, with the proportions of dyes and pigments employed being about 0.02% for the dyes and about 0.2% for the pigments. The dyed products are transparent or translucent and the pigmented products are opaque. The opacities of the pigmented products are further increased by additions of 1, 2 and 5% of powdered clay to the initial mixture, which also converts the colors to pastels.

The formulas described in this example are modified proportionately ±10%, ±20, and ±30%, within the ranges given and the products resulting are useful elastic detergent products of this invention.

EXAMPLE 2

| | Percent |
|---|---|
| Ammonium cocomonoglyceride sulfate (47% active ingredient) | 24.2 |
| Triethanolamine salt of Miranol C2M | 28.0 |
| Gelatin (300 g. Bloom, type A) | 10.0 |
| Propylene glycol | 10.0 |
| Water | 27.8 |

Elastic detergent bars of the above formula and of such a formula less 25% of water removed in a drying operation after dissolving of the gelatin are made according to the method of Example 1. The bars produced are useful elastic detergent bars for bath use or handwashing and are less tacky and better foaming than similar bars not containing the mixture of anionic and amphoteric detergents. Also, the bars made by a process including removal of moisture, as described, are less liable to shrink on storage exposed to the air than are similar bars containing the greater percentages of moisture. The improved bars, made by reducing the moisture content, analyze about 30% of ammonium cocomonoglyceride sulfate, 35% of triethanolammonium 1-carboxymethyl-1-carboxyethoxyethyl-2-coco-imidazolinium betaine, 13% of gelatin, 12% of propylene glycol and 10% of water. The removal of moisture in the above-described process and other such processes of this invention takes place at a temperature of 30° to 90° C., preferably 40° to 80° C., with the lower temperatures being used most when vacuum is also employed.

EXAMPLE 3

| | Percent |
|---|---|
| Miranol C2M, anhydrous acid | 21 |
| Triethanolamine | 7.5 |
| Propylene glycol | 10.0 |
| Gelatin (300 g. Bloom, Type A) | 10.0 |
| Triethanolamine lauryl sulfate (40% active ingredient, aqueous solution) | 28.5 |
| Ammonium cocomonoglyceride sulfate (47% active ingredient, aqueous solution) | 23.0 |

Following the procedure of Example 1, products of the above formula are made, without moisture removal. They are good elastic detergent bars for both bath use and handwashing and are less tacky and better foaming than similar bars containing either anionic detergent or amphoteric detergent alone. Also, because of their comparatively low moisture content the bars are less liable to shrinkage on storage and when exposed to air than are similar bars containing more moisture.

In normal handwashing use a 100 gram molded bar and molded items in the shapes of cartoon characters, automobiles and animals last for at least 200 handwashings at a water temperature of 40° C., give a copious foam and wash well. They clean well and leave the hands feeling soft, apparently due to the gelatin and amphoteric detergent contents of the products. When 150 gram bars or articles are utilized they last for as many as 20 normal baths, with good foaming throughout such use. During wearing down of the "bars" they substantially retain their general original shapes, colors and foaming and washing abilities.

EXAMPLE 4

The product of Example 3 is made from an initial mixture which includes 45% of water instead of the 30% in the final product and in the mix of Example 3. The excess moisture is removed during manufacturing by heating for about 45 minutes at a temperature of about 75° C., without vacuum. Comparison of the products of Examples 3 and 4 shows little difference between them except that the product of Example 4 may have the components thereof more uniformly distributed throughout it due to the initial dissolvings of more of them in the aqueous medium before removal of excess moisture. Also, initial mixing and dissolving of the mix of this example is much easier. In a further modification of this example the density of the product is diminished 10%, so that it will float in warm bath water, by distributing small bubbles of air throughout it after removal of the excess moisture from the mixed solution and after cooling of such mix, following the procedure in an application by John C. Carson, Jr. and James A. Bowers, entitled Elastic Detergent Bar of Improved Elevated Temperature Stability, filed simultaneously with this application. The product resulting is an excellent "floating soap" for use in the bath tub but unlike soap, it and the other products of this invention leave no bathtub ring and it is a superior floating toy for the child when he takes a bath.

The invention has been described with respect to various embodiments and illustrations thereof but is not to be limited to these because it is evident that one of skill in the art with the present specification before him will be able to utilize substitutes and equivalents without departing from the spirit of the invention.

What is claimed is:

1. An elastic detergent product comprising about 10 to 80% of a mixture of an anionic synthetic organic detergent selected from the group consisting of alkali metal monoglyceride sulfate, ammonium monoglyceride sulfate, triethanolammonium higher fatty alcohol sulfate and mixtures thereof, and an amphoteric synthetic organic detergent, in a proportion between about 1:5 and 5:1, about 5 to 30% of gelatin and about 5 to 60% of water.

2. An elastic detergent product according to claim 1 wherein the amphoteric synthetic organic detergent is selected from the group consisting of imidazolinium betaines and betaimino dipropionates and mixtures thereof, the proportion of anionic to amphoteric synthetic organic detergent is in the range of 1:4 to 2:1, and the gelatin is a Type A gelatin of 100 to 300 Bloom.

3. An elastic detergent product according to claim 2 wherein the mixture of anionic and amphoteric synthetic organic detergents is from 35 to 70% of the bar, the gelatin is of 200 to 300 g. Bloom and is 7 to 25% of the bar and the moisture content is from 10 to 40%.

4. An elastic detergent product according to claim 3 which comprises about 3 to 20% of lower dihydric or polyhydric alcohol.

5. An elastic detergent product according to claim 3 wherein the anionic synthetic organic detergent is triethanolammonium lauryl sulfate and the amphoteric synthetic organic detergent is triethanolammonium 1-carboxymethyl-1-carboxyethoxyethyl-2-coco-imidazolinium betaine.

6. An elastic detergent product according to claim 3 wherein the anionic synthetic organic detergent is ammonium cocomonoglyceride sulfate and the amphoteric synthetic organic detergent is triethanolammonium 1-carboxymethyl-1-carboxyethoxyethyl-2-coco-imidazolinium betaine.

7. An elastic detergent product according to claim 4 wherein the anionic synthetic organic detergent is triethanolammonium lauryl sulfate and the amphoteric synthetic organic detergent is triethanolammonium 1-carboxymethyl-1-carboxyethoxyethyl-2-coco-imidazolinium betaine.

8. An elastic detergent product according to claim 4 wherein the anionic synthetic organic detergent is ammonium cocomonoglyceride sulfate and the amphoteric synthetic organic detergent is triethanolammonium 1-carboxymethyl-1-carboxyethoxyethyl-2-coco-imidazolinium betaine.

9. An elastic detergent product according to claim 7 comprising about 11% of triethanolammonium lauryl sulfate, about 38% of triethanolammonium 1-carboxymethyl-1-carboxyethoxyethyl-2-coco-imidazolinium betaine, about 13% of 300 g. Bloom gelatin, about 13% of propylene glycol, and about 25% of water.

10. An elastic detergent product according to claim 8 comprising about 30% of ammonium cocomonoglyceride sulfate, about 35% of triethanolammonium 1-carboxymethyl-1-carboxyethoxyethyl-2-coco-imidazolinium betaine, about 13% of 300 g. Bloom gelatin, about 12% of propylene glycol and about 10% of water.

11. An elastic detergent product according to claim 9 which is in the form of a squeezable cartoon character or animal, and which is translucent and squeezable.

12. A method of making an elastic detergent product comprising about 10 to 80% of a mixture of anionic and amphoteric synthetic organic detergents in a proportion between about 1:5 and 5:1, about 5 to 30% of gelatin and about 5 to 40% of water which comprises heating together a mixture of such components, with additional water to promote solubilization of the gelatin and evaporating off water in a proportion from 15 to 50% of the weight of the mixture.

13. A method according to claim 12 wherein the elastic detergent product comprises about 35 to 65% of a mixture of triethanolammonium lauryl sulfate and triethanolammonium 1-carboxymethyl-1-carboxyethoxyethyl-2-coco-imidazolinium betaine in a proportion within the range of 1:4 to 2:1, 7 to 25% of a type A gelatin of 100 to 300 g. Bloom and 10 to 40% of water which comprises heating a mixture of such components in an aqueous medium containing 25 to 60% of water until the gelatin is dissolved, continuing heating until 20 to 40% of the mix weight of water is removed, deaerating the composition and pouring it into a mold.

14. A method according to claim 12 wherein the elastic detergent product comprises about 35 to 70% of a mixture of ammonium cocomonoglyercide sulfate and triethanolammonium 1-carboxymethyl-1-carboxyethoxyethyl-2-coco-imidazolinium betaine in a proportion within the range of 1:4 to 2:1, 7 to 25% of a type A gelatin of 100 to 300 g. Bloom and 10 to 40% of water which comprises heating a mixture of such components in an aqueous medium containing 25 to 60% of water until the gelatin is dissolved, continuing heating until 20 to 40% of the mix weight of water is removed, deaerating the composition, pouring it into a mold, chilling and solidifying it and removing it from the mold.

15. A process according to claim 14 wherein the product comprises about 30% of ammonium cocomonoglyceride sulfate and about 38% of triethanolammonium-1-carboxyethyl-1-carboxyethoxythyl-2-coco-imidazolinium betaine, and is in the form of a squeezable cartoon character or animal which is translucent and squeezable, and the chilling is to solidification.

* * * * *